US008663747B2

(12) United States Patent
Quist et al.

(10) Patent No.: US 8,663,747 B2
(45) **Date of Patent: *Mar. 4, 2014**

(54) PROCESS FOR THE MANUFACTURING OF DECORATIVE BOARDS

(75) Inventors: Magnus Quist, Trelleborg (SE); Peter Miller, Trelleborg (SE); Jan Ericsson, Helsingborg (SE)

(73) Assignee: Pergo (Europe) AB, Trelleborg (SE)

( * ) Notice: Subject to any disclaimer, the term of this patent is extended or adjusted under 35 U.S.C. 154(b) by 52 days.

This patent is subject to a terminal disclaimer.

(21) Appl. No.: 13/188,236

(22) Filed: Jul. 21, 2011
(Under 37 CFR 1.47)

(65) Prior Publication Data

US 2012/0082798 A1 Apr. 5, 2012

Related U.S. Application Data

(62) Division of application No. 10/471,865, filed as application No. PCT/SE02/00453 on Mar. 13, 2002, now Pat. No. 7,985,444.

(30) Foreign Application Priority Data

Mar. 14, 2001 (SE) ..... 0100860

(51) Int. Cl.
*B05D 1/06* (2006.01)
*B05D 3/12* (2006.01)

(52) U.S. Cl.
USPC ..... 427/475; 427/469; 427/470; 427/369

(58) Field of Classification Search
USPC ..... 427/469, 470, 475, 369
See application file for complete search history.

(56) References Cited

U.S. PATENT DOCUMENTS

| | | | | |
|---|---|---|---|---|
| 3,208,901 | A | 9/1965 | Kelley et al. | |
| 3,247,047 | A * | 4/1966 | Buckley | 428/151 |
| 3,513,012 | A * | 5/1970 | Point | 427/470 |
| 3,904,791 | A | 9/1975 | Iverson et al. | |
| 3,996,154 | A | 12/1976 | Johnson et al. | |
| 4,113,894 | A | 9/1978 | Koch, II | |
| 4,122,225 | A | 10/1978 | Holmstrom et al. | |
| 4,759,955 | A | 7/1988 | Hsu et al. | |
| 5,075,057 | A | 12/1991 | Hoedl | |
| 5,348,778 | A | 9/1994 | Knipp et al. | |
| 5,571,323 | A | 11/1996 | Duffy et al. | |
| 5,635,548 | A * | 6/1997 | Kittle et al. | 523/220 |
| 5,792,558 | A * | 8/1998 | Jonas et al. | 428/419 |
| 5,824,373 | A * | 10/1998 | Biller et al. | 427/474 |
| 5,993,915 | A | 11/1999 | Krebsbach | |
| 6,006,486 | A * | 12/1999 | Moriau et al. | 52/589.1 |
| 6,017,640 | A | 1/2000 | Muthiah et al. | |
| 6,093,473 | A | 7/2000 | Min | |
| 6,093,481 | A | 7/2000 | Lynn et al. | |
| 6,100,316 | A | 8/2000 | Lobert | |
| 6,101,778 | A | 8/2000 | Martensson | |
| 6,106,654 | A | 8/2000 | Velin et al. | |
| 6,136,370 | A | 10/2000 | Muthiah et al. | |
| 6,291,078 | B1 | 9/2001 | Chen et al. | |
| 6,421,970 | B1 | 7/2002 | Martensson et al. | |
| 6,465,046 | B1 * | 10/2002 | Hansson et al. | 427/256 |
| 6,588,166 | B2 | 7/2003 | Martensson et al. | |
| 6,685,993 | B1 * | 2/2004 | Hansson et al. | 427/551 |
| 7,985,444 | B2 * | 7/2011 | Quist et al. | 427/202 |
| 2002/0114883 | A1 * | 8/2002 | Mushett et al. | 427/163.4 |

FOREIGN PATENT DOCUMENTS

| | | |
|---|---|---|
| DE | 3630315 | 3/1988 |
| GB | 2324982 | 11/1998 |
| WO | WO 98/29265 | 7/1998 |
| WO | WO 98/50207 | 11/1998 |

* cited by examiner

*Primary Examiner* — Frederick Parker
(74) *Attorney, Agent, or Firm* — Jenkins, Wilson, Taylor & Hunt, P.A.

(57) ABSTRACT

A process for manufacturing a coated panel. The process can comprise providing a panel of a desired dimension or cutting a panel to a desired dimension. In some embodiments a panel can be provided with joining functionality. A surface of the panel can be coated with a powder and the powder cured to thereby treat a surface of the panel.

23 Claims, 5 Drawing Sheets

PROCESS FOR THE MANUFACTURING OF DECORATIVE BOARDS

CROSS-REFERENCE TO RELATED APPLICATIONS

This application is a divisional application of Ser. No. 10/471,865 filed Apr. 30, 2004, now U.S. Pat. No. 7,985,444, which in turn is a §371 Application of International Application No. PCT/SE02/00453, filed on Mar. 13, 2002, claiming the priority of Swedish Application No. 0100860-6, filed Mar. 14, 2001, the entire disclosures of which are incorporated herein by reference in their entireties.

The present invention relates to a process for the manufacturing of a decorative boards with a decorative upper surface.

Products clad with thermosetting laminate is common in many areas nowadays. They are mostly used where the demands on abrasion resistance are high, and furthermore where resistance to different chemicals and moisture is desired. As examples of such products floors, floor skirtings, table tops, work tops and wall panels can be mentioned.

The thermosetting laminate most often consist of a number of base sheets with a décor sheet placed closest to the surface. The décor sheet can be provided with a pattern by desire. Common patterns usually visualize different kinds of wood or mineral such as marble and granite. Also fantasy based décor and monochrome décor are rather common.

When manufacturing laminate boards comprising thermosetting laminate the process normally includes the steps; printing décor on a paper of α-cellulose, impregnating the decorative paper with melamine-formaldehyde resin, drying the decorative paper, laminating the decorative paper under heat and pressure together with similarly treated supporting papers, applying the decorative laminate on a carrier and finally sawing and milling the carrier to the desired format. All these steps in the manufacturing are very time consuming and will cause waste of the thermosetting laminate. The thermosetting laminate is a rather costly part of a laminate floor.

Another problem with thicker laminates with a core of particle board or fiber board is that these normally will absorb a large amount of moisture, which will cause them to expand and soften whereby the laminate will warp. The surface layer might even, partly or completely come off in extreme cases since the core will expand more than the surface layer. This type of laminate can therefore not be used in humid areas, such as bath rooms or kitchens, without problems.

The problems can be partly solved by making the core of paper impregnated with thermosetting resin as well. Such a laminate is most often called compact laminate. These compact laminates are, however, very expensive and laborious to obtain as several tens of layers of paper have to be impregnated, dried and put in layers.

The above mentioned problems have, through the present invention been solved and a rational process for manufacturing moisture resistant decorative boards is achieved. The invention relates to a process for the manufacturing of decorative boards with an abrasion resistant surface and edges with joining functionality. The process comprise the steps;

a) Cutting a carrier board to the desired dimension and molding edges with joining functionality.

b) Treating at least the upper surface of the board.

c) Applying radiation curable dry acrylic lacquer powder by means of electrostatic spray nozzles.

d) Heating the acrylic lacquer so that it melts.

e) Curing the acrylic lacquer by means of radiation, the radiation being selected from the group consisting of UV-radiation and electron beam radiation.

It is, due to the method of lacquer application, possible to utilize boards with a structured surface. This structure can be achieved at any stage before cutting the board to the desired dimension or during treating of the upper surface of the board. Such a structure on the board is suitably rather rough as the lacquer will tend to level the surface. This implies that structure depth should be at least 0.5 mm.

The upper surface of the board can according to one embodiment of the invention be pressed with a heated calendar roller. The surface temperature of the calendar roller is suitably in the range 45-150° C. The calendar roller preferably exerts a pressure on the board in the range 10-100 bar. The calendar roller may be provided with either a plane surface, whereby the surface of the board will be plane, or a structured surface in order to achieve a surface structure on the board. It is advantageous to utilize two rollers where one is plane and the other one structured in cases where the surface of the boards is to be structured by means of rollers as described above. The calendar pressing of the board will increase the surface density as well as leveling the micro structure of the surface and is an alternative to sanding. Sanding may also show impractical on structured surfaces. On plane surfaces or on boards with selected surface structures the board surface can be sanded smooth before applying the acrylic lacquer.

The preparations may also, or alternatively, include a primer applied on the board before applying the acrylic lacquer.

A board manufactured according to the present invention may be provided with several types of décor which are applied in different manners. According to one embodiment of the invention a decorative foil is applied on the board before applying the acrylic lacquer. According to one alternative embodiment a décor is printed on the upper surface before applying the acrylic lacquer. The two above mentioned methods of applying décor are well suited for more complex décor containing several colors like for example when simulating wood like pine, birch and mahogany or when simulating minerals like marble and sandstone. These methods of applying décor are of course flexible and also be used for applying décor which is fantasy based or even monochrome.

In some cases, as for example on boards intended for use on floors where a very high degree of abrasion resistance is desirable, an intermediate stage of adding extra abrasion resistance is desirable, an intermediate stage of adding extra abrasion resistance is added to the process according to one embodiment of the invention. This extra abrasion resistance is applied before applying the acrylic lacquer. Extra abrasion resistance will be need in extreme cases of abrasion as for example on floors in public environments like hotel lobbies or the like.

According to one embodiment of the invention the upper surface of the board is coated with bonding layer to an amount of 10-40 g/m$^2$. Hard particles with an average particle size in the range 40-150 μm are then sprinkled to an amount of 1-30 g/m$^2$ on the sticky bonding layer. The hard particles are selected from the group consisting of aluminum oxide, silicon oxide, silicon carbide and mixtures thereof. The bonding layer is suitably a wet UV-curable acrylic lacquer, which bonding layer is cured after having applied the hard particles. The bonding layer may also be a dry UV- or electron beam curable acrylic lacquer which is melted before applying the hard particles.

According to one embodiment of the invention the board is preheated before applying the acrylic lacquer. This will shorten the time period for the melting process. The preheating is suitably arranged so that the surface temperature of the board is in the range 40 to 150° C. when the application of acrylic lacquer is initiated. The preheating is alternatively arranged so that the core temperature of the board is in the range of 40-150° C. when the application of acrylic lacquer is initiated.

The acrylic lacquer is preferably applied to an amount of 10-250 g/m$^2$. Since abrasion will be higher on the upper side of the board the acrylic lacquer is suitably applied to an amount of 50-250 g/m$^2$ on the upper surface of the board, while it sufficient to apply the acrylic lacquer to an amount of 10-70 g/m$^2$ on the lower surface of the board. The acrylic lacquer is suitably applied to an amount of 10-100 g/m$^2$ on the edges of the board. The amount of lacquer to be applied on the edges is taken into consideration when molding of the edges.

In order to increase the abrasion resistance the acrylic lacquer applied on the upper surface preferably comprises hard particles selected from the group consisting of aluminum oxide, silicon oxide and silicon carbide. The hard particles preferably have an average particle size in the range 1-150 μm, suitably an average particle size in the range of 1-50 μm. The particles may be premixed with the acrylic lacquer prior to the application. According to one embodiment of the invention the hard particles are mixed with the acrylic lacquer in the nozzles during the coating process. This will make it possible to easily adjust the amount of particles on the surface giving great flexibility to the process.

The acrylic lacquer is applied by separate groups of nozzles, the groups comprising an upper surface coating group, a rear surface coating group and at least one edge coating group. According to one embodiment of the invention the number of edge coating groups are two. According to one another embodiment of the invention the number of edge coating groups are four.

In certain embodiments of the invention the edges are provided with joining functionality comprising snap-action interlocking. Such joint will most often have a rather complicated cross-section in which surfaces are facing away from a reasonable position of lacquer application nozzle. In order to ensure that an even distribution of lacquer is achieved the acrylic lacquer applied on the edges is preferably guided by means of an air stream, the air stream being achieved by means of a narrow air evacuation tube, the air evacuation tube having a suction nozzle which is arranged adjacent to recesses and pockets molded in the edge whereby a more uniform coating is achieved on the edge.

The dry acrylic lacquer will have to be melted before curing. According to one embodiment of the invention the acrylic lacquer is melted by means of hot air environment. According to another embodiment of the invention the acrylic lacquer is melted by means of infrared radiation. In certain embodiments of the invention the edges are provided with joining functionality comprising snap-action interlocking. Such joint will most often have a rather complicated cross-section in which surfaces are facing away from a reasonable position of an infrared radiator. In order to ensure that the lacquer is evenly melted the acrylic lacquer applied on the edges is illuminated with the infrared radiation via reflectors. The reflectors can be made be small enough to be placed inside a groove.

In embodiments where the molten acrylic lacquer is cured by means of UV radiation, the acrylic lacquer applied on the edges are suitably illuminated with UV light via reflectors in manners similar to the melting process described above.

The invention is described further in connection to process schemes below.

PROCESS SCHEME 1

Figure 1:
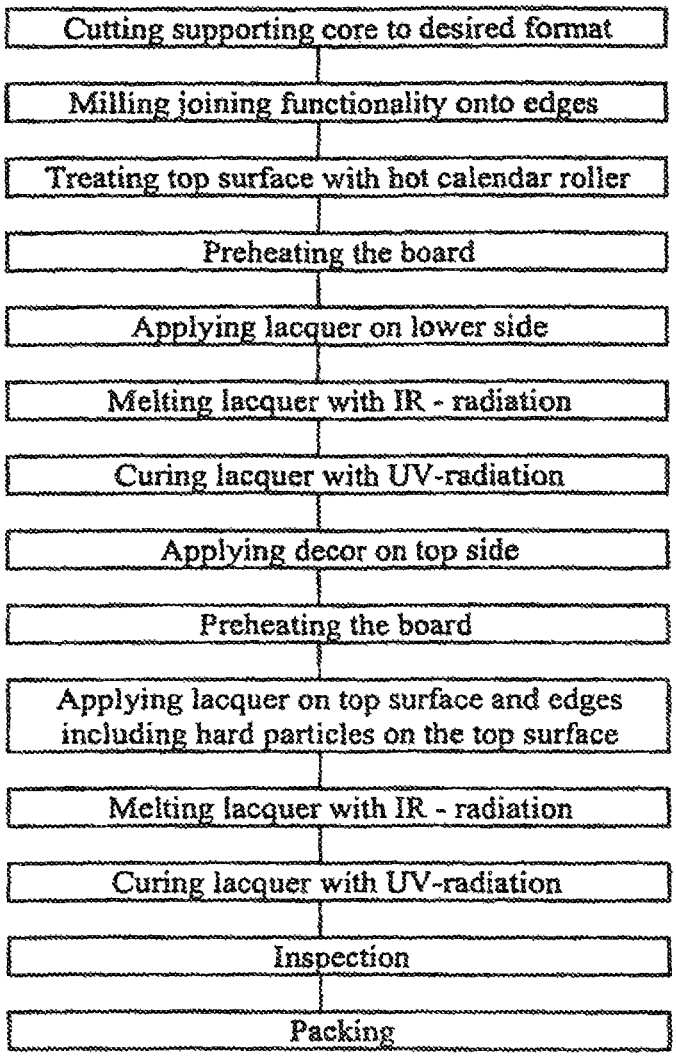
FIG. 1 is a flow diagram of a first embodiment known as Process Scheme 1.
Figure 2:
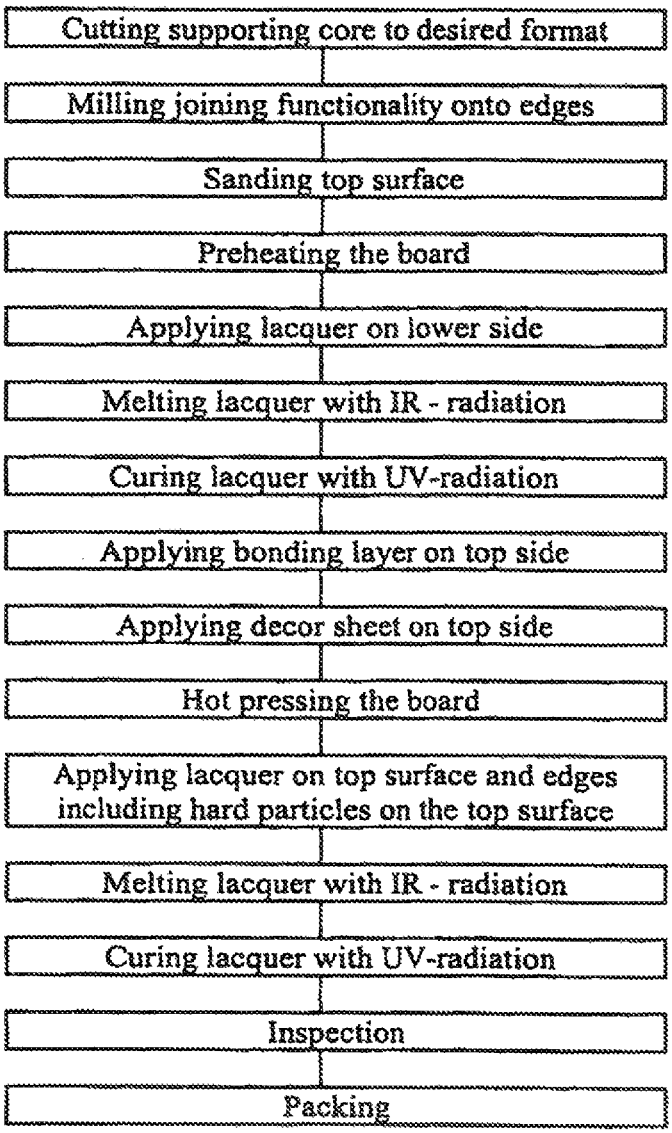
FIG. 2 is a flow diagram of a first embodiment known as Process Scheme 2.
Figure 3:
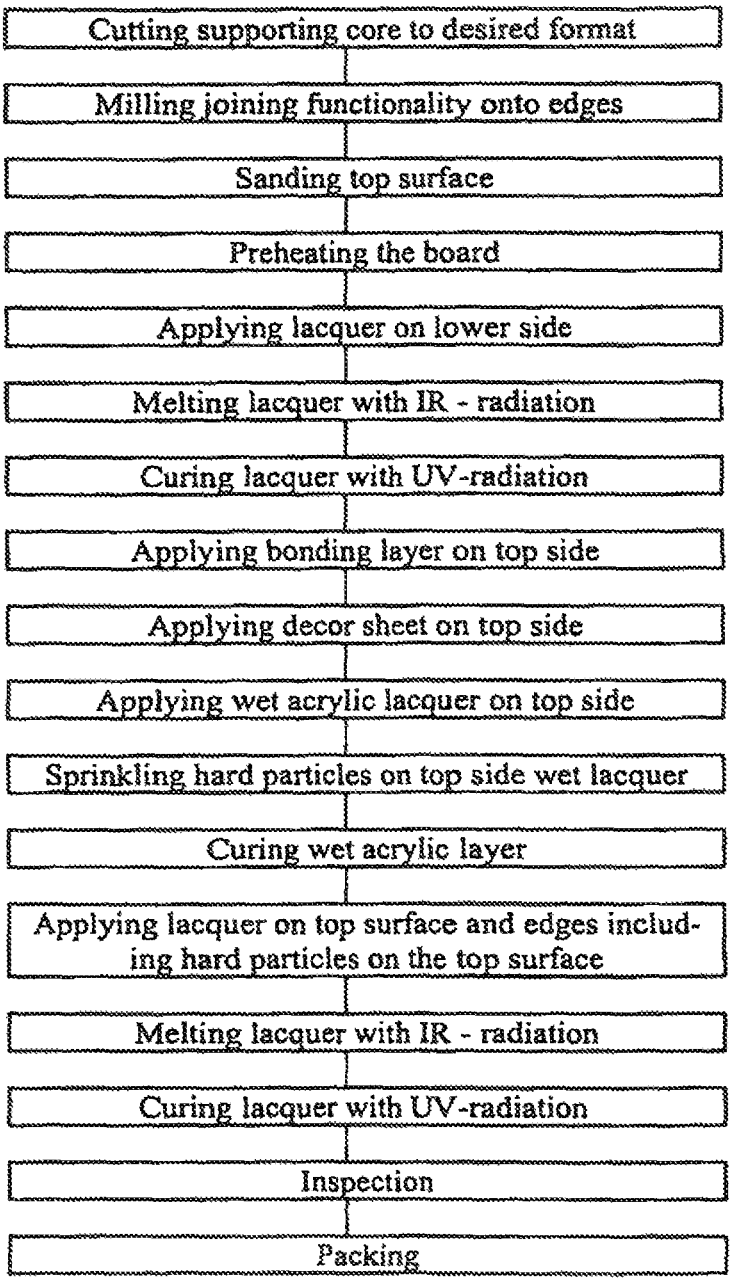
FIG. 3 is a flow diagram of a first embodiment known as Process Scheme 3.
Figure 4:
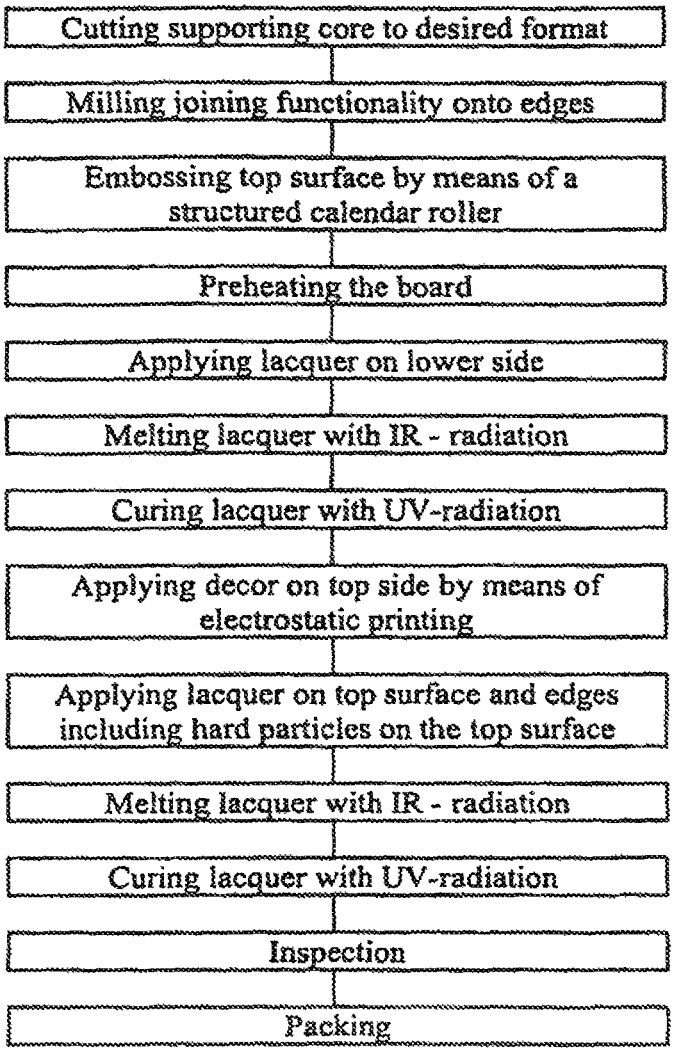
FIG. 4 is a flow diagram of a first embodiment known as Process Scheme 4.
Figure 5:
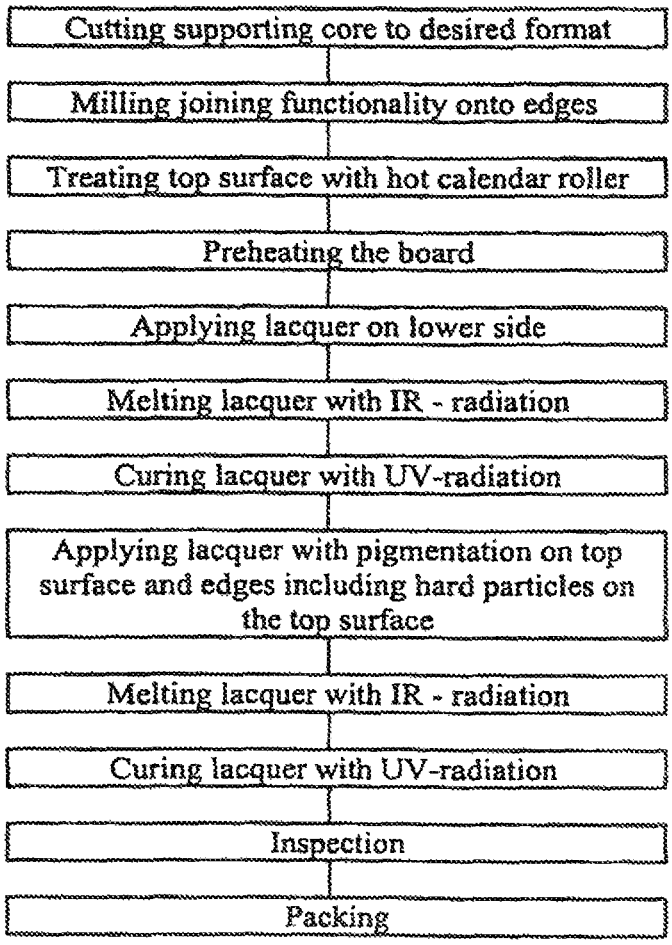
FIG. 5 is a flow diagram of a first embodiment known as Process Scheme 5.

A supporting core is cut to the desired board format and is provided with an upper side, a lower side and edges provided with joining functionality, such as tongue and groove.

The side intended to become the upper side of the board is then pressed with a hot calendar roller. The surface temperature of the calendar roller is 60° C. while the pressure is 60 bar.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 50 g/m$^2$. The acrylic powder applied is then heated to a temperature of 100° C. by means of IR-radiation so that it melts whereby the melted acrylic layer is cured by means of UV-radiation so that it cures. The board is then turned so that the side intended as the upper side of the finished board is facing upwards. A décor is then applied on the upper side by means of a digital photo-static printer. The décor is positioned from a predetermined fixing point in form of a corner of the supporting core, while the décor direction is aligned with the long side edge initiating from the same corner.

The decorated board is then heated whereby a wear layer of UV-curing dry acrylic lacquer powder is applied by means of a group of electrostatic spray nozzles to an amount of 170 g/m$^2$. Hard particles of aluminum oxide with an average particle size of 30 μm to an amount of 10 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

PROCESS SCHEME 2

A supporting core is cut to the desired board format and is provided with an upper side, a lower side and edges provided with joining functionality, such as tongue and groove.

The side intended to become the upper side of the board is then sanded smooth.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished boards is facing upwards. A décor sheet is then applied on the upper side after having applied a bonding layer. The décor sheet may be constituted of paper impregnated with for example acrylic resin or melamine formaldehyde resin. The décor sheet may alternatively be constituted of a polymeric foil.

The decorated board is then heated whereby a wear layer of UV-curing dry acrylic lacquer powder is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means IR-radiation so that it melts whereby the melted acrylic layer is cured by means of UV-radiation so that it cures. Reflectors are used to illuminate hidden corners of the profiles on edges with both IR- and UV-radiation when required. The boards are after cooling ready final inspection and packing.

PROCESS SCHEME 3

A supporting core is cut to the desired board format and is provided with an upper side, lower side and edges provided with joining functionality, such as tongue and groove.

The side intended to become the upper side of the board is then sanded smooth.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 100° C. by means of IR-radiation so that it melts whereby the melted acrylic layer is cured by means of UV-radiation so that it cures. The board is then turned so that the side intended as the upper side of the finished boards is facing upwards. A décor sheet is then applied on the upper side after having applied a bonding layer. The décor sheet may be constituted of paper impregnated with for example acrylic resin or melamine formaldehyde resin. The décor sheet may alternatively be constituted of a polymeric foil.

A layer of wet UV-curable acrylic lacquer is then applied on top of the décor sheet by means of roller coating to a lacquer amount of 30 g/m$^2$. 10 g/m$^2$ of hard particles of aluminum oxide with an average particle size of 100 μm is then sprinkled on the still wet layer of lacquer whereupon the lacquer is cured by means of UV-radiation.

The board is then heated whereby a wear layer of UV-curing dry acrylic lacquer powder is applied by means of a groups of electrostatic spray nozzles to an amount of 180 g/m$^2$. Hard particles of aluminum oxide with an average particle size of 30 μm to an amount of 11 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount 80 g/m$^2$. The acrylic powder applied is then heated to temperature of 100° C. by means of IR-radiation so that it melts whereby the melted acrylic layer is cured by means of UV-radiation so that it cures. Reflectors are used to illuminate hidden corners of the profiles on the edge with both IR- and UV-radiation when required. The boards are after cooling ready final inspection and packing.

PROCESS SCHEME 4

A supporting core is cut to the desired board format and is provided with an upper side, a lower side and edges provided with joining functionality, such as tongue and groove.

The side intended to become the upper side of the board is then embossed by pressing a heated structured calendar roller towards the upper surface. The surface temperature of the calendar roller is 60° C. while the pressure is 60 bar.

The board is then arranged so that the side intended as the lower side is facing upwards. The board is then heated whereby a wear layer of UV-caring dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished board is facing upwards. A décor is then printed on the upper side by means of an electrostatic printer.

The decorated board is then heated whereby a wear layer of UV-curing dry acrylic lacquer powder is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group of electrostatic edge coating nozzles to an amount of 80 g/m$^2$. The acrylic powder applied is then heated to a temperature of 105° C. by means IR-radiation so that it melts whereby the melted acrylic layer is cured by means of UV-radiation so that it cures. Reflectors are used to illuminate hidden corners of the profiles on the edges with both IR- and UV-radiation when required. The boards are after cooling ready final inspection and packing.

PROCESS SCHEME 5

A supporting core is cut to the desired board format and is provided with an upper side, a lower side and edges provided with joining functionality, such as a tongue and groove.

The side intended to become the upper side of the board is treated with a hot calendar roller. The surface temperature of the calendar roller is 60° C. while the pressure is 60 bar.

The board is then arranged so that the side intended as the lower side is facing upwards. The board is then heated whereby a wear layer of UV-curing dry acrylic lacquer powder is applied on the lower side, now facing upwards, by means of a group of electrostatic spray nozzles to an amount of 70 g/m$^2$. The acrylic powder applied is then heated to a temperature of 105° C. by means of IR-radiation so that it melts whereby the melted acrylic layer is cured by means of UV-radiation so that it cures. The board is then turned so that the side intended as the upper side of the finished board is facing upwards.

The board is then heated whereby a wear layer of UV-curing dry acrylic lacquer powder with comprising color pigments is applied by means of a group of electrostatic spray nozzles to an amount of 200 g/m$^2$. Hard particles of aluminum oxide with an average particle size of 30 μm to an amount of 12 g/m$^2$ is added through a separate nozzle within the spray nozzles so that they become evenly distributed within the wear layer of the upper side. The edges are coated with UV-curing dry acrylic lacquer by means of separate group electrostatic edge coating nozzles to an amount of 80 g/m$^2$. The acrylic powder applied is then heated to a temperature of 105° C. by means of IR-radiation so that it melts whereby the melted acrylic layer is cured by means of UV-radiation so that it cures. Reflectors are used to illuminate hidden corners of the profiles on the edges with IR- and UV-radiation when required. The boards are after cooling ready final inspection and packing.

We claim:

1. A process for creating and coating a panel comprising the steps of:

a. providing a panel having at least an upper surface, a lower surface, and edges joining the upper surface and the lower surface, wherein the upper surface is of a desired dimension, and wherein at least one of the edges comprises a joining functionality;

b. pressing the upper surface of the panel, wherein the pressing imparts a surface structure to the upper surface;

c. dispersing a powder on at least the upper surface of the panel via electrostatic charging;

d. curing the powder on the surface to form a sealed surface whereby the surface forms a coating providing at least one property of abrasion resistance and scratch resistance on the surface; and, e. obtaining a panel with a coated upper surface without any further cutting of the panel.

2. The process of claim 1, wherein the powder comprises a resin.

3. The process of claim 1, wherein the powder comprises an acrylic lacquer.

4. The process of claim 1, further comprising dispersing particles selected from the group consisting of aluminum oxide, silicon oxide, silicon carbide and mixtures thereof on the panel.

5. The process of claim 4, wherein the powder and the particles are each dispersed via electrostatic charging.

6. The process of claim 4, wherein the powder and the particles are dispersed simultaneously.

7. The process of claim 5, further comprising dispersing the powder and dispersing the particles via separate electrostatic charging nozzles.

8. The process of claim 1, further comprising applying a décor to the panel before the step of dispersing the powder.

9. The process of claim 4, wherein the decor is printed on the panel.

10. The process of claim 9, wherein the decor is digitally printed.

11. The process of claim 8, wherein the decor is a printed or monochromatic paper.

12. The process of claim 8, wherein the coating forms a wear layer over the decor.

13. The process of claim 12, wherein the wear layer comprises a cured powder and particles selected from the group consisting of aluminum oxide, silicon oxide, silicon carbide and mixtures thereof.

14. The process of claim 1, further comprising melting the powder, and applying particles selected from the group consisting of aluminum oxide, silicon oxide, silicon carbide and mixtures thereof on the melted powder.

15. The process of claim 1, further comprising melting the powder and at least partially curing the melted powder and applying particles selected from the group consisting of aluminum oxide, silicon oxide, silicon carbide and mixtures thereof to the at least partially cured melted powder.

16. The process of claim 1, wherein the steps (c) and (d) are each performed more than once.

17. The process of claim 1, wherein the surface structure has a depth of at least 0.5 mm.

18. The process of claim 1, further comprising performing the pressing step at a pressure in the range of 10-100 bar.

19. The process of claim 1, further comprising performing the pressing step with a calendar roller.

20. The process of claim 1, further comprising the step of dispersing a powder via electrostatic spraying to at least one element selected from the group consisting of the lower surface and the edges.

21. The process of claim 1, further comprising the steps of applying a coating of a bonding layer on the upper surface, and sprinkling particles selected from the group consisting of aluminum oxide, silicon oxide, silicon carbide and mixtures thereof on the bonding layer before the step of dispersing the powder.

22. The process of claim 1, wherein the step of providing the panel comprises cutting the panel to the desired dimension.

23. A process for creating and coating a panel comprising the steps of:

providing a panel having at least an upper surface, a lower surface, and edges joining the upper surface and the lower surface;

pressing the upper surface of the panel;

dispersing a powder and particles on a surface of the panel, wherein the powder comprises a resin, wherein the particles are selected from the group consisting of aluminum oxide, silicon oxide, silicon carbide and mixtures thereof, wherein the powder and the particles are dispersed simultaneously;

curing the powder to form a sealed surface whereby the surface forms a coating providing at least one property of abrasion resistance and scratch resistance on the surface; and providing joining functionality on at least one of the edges.

* * * * *